US007278827B2

(12) United States Patent
Boury et al.

(10) Patent No.: US 7,278,827 B2
(45) Date of Patent: Oct. 9, 2007

(54) COOLING AIR EVACUATION SLOTS OF TURBINE BLADES

(75) Inventors: Jacques Boury, Saint Ouen en Brie (FR); Maurice Judet, Dammarie les Lys (FR); Jacky Tabardin, Villiers le Bel (FR)

(73) Assignee: Snecma Moteurs, Paris (FR)

( * ) Notice: Subject to any disclaimer, the term of this patent is extended or adjusted under 35 U.S.C. 154(b) by 323 days.

(21) Appl. No.: 11/032,012

(22) Filed: Jan. 11, 2005

(65) Prior Publication Data

US 2005/0249593 A1 Nov. 10, 2005

(30) Foreign Application Priority Data

Jan. 14, 2004 (FR) ..... 04 00289

(51) Int. Cl.
*F01D 5/18* (2006.01)

(52) U.S. Cl. ..... 416/97 R

(58) Field of Classification Search ..... 415/115; 419/97 R

See application file for complete search history.

(56) References Cited

U.S. PATENT DOCUMENTS 6,062,817 A 5/2000 Danowski et al.
6,328,531 B1 * 12/2001 Bariaud et al. ..... 416/97 R
6,612,811 B2 * 9/2003 Morgan et al. ..... 416/97 R
2003/0108423 A1 6/2003 Morgan et al.

FOREIGN PATENT DOCUMENTS

EP 0 945 594 A1 9/1999
EP 0 978 634 A1 2/2000
EP 1 016 773 A2 7/2000
EP 2 835 015 A1 7/2003

* cited by examiner

*Primary Examiner*—Edward K. Look
*Assistant Examiner*—Devin Hanan
(74) *Attorney, Agent, or Firm*—Oblon, Spivak, McClelland, Maier & Neustadt, P.C.

(57) ABSTRACT

A turbine blade of a turbomachine, having at least a bottom platform connected to the base of the blade by a bottom connection zone, and a cooling circuit consisting of at least one cooling cavity, of a plurality of evacuation slots arranged along the trailing edge of the blade, said blade having a bottom evacuation slot that is disposed near the blade base, the bottom evacuation slot including an end wall provided with an opening that opens into the cavity, a setback wall, a bottom wall disposed beside the blade base, a bottom edge formed between the setback wall and the bottom wall, and a bottom shoulder formed between the bottom wall and the bottom connection zone, both the bottom edge of the bottom evacuation slot and the bottom shoulder of the bottom evacuation slot having respective right sections of substantially rounded shape, thereby avoiding any protruding angles between the opening of said slot and the bottom connection zone.

19 Claims, 5 Drawing Sheets

COOLING AIR EVACUATION SLOTS OF TURBINE BLADES

BACKGROUND OF THE INVENTION

The present invention relates to the general field of turbine blades, and, more particularly, to the shape of the cooling air evacuation slots in the trailing edges of rotor or stator blades of a turbomachine turbine.

A turbomachine turbine (e.g. a high-pressure turbine) consists of a plurality of stages each made up of a stator nozzle and a rotor wheel. The turbine nozzle has a plurality of stator blades designed to redirect the gas stream going through it, and the rotor wheel of the turbine is constituted by a plurality of moving blades.

The rotor and stator blades of such a turbine are subjected to the very high temperatures of the gases coming from the combustion chamber and passing through the turbine. These temperatures reach values that are much higher than those which the blades that are in contact with the gas can withstand without being damaged, thereby shortening their lifetime.

In order to reduce the damage said hot gases cause the blades, there exist systems that provide the blades with internal cooling circuits for reducing the temperature of said blades. Using such circuits, the cooling air that is introduced into a blade passes through said blade along a path formed by cavities made in the blade before being expelled via slots that open out in the surface of the blade, between the blade base and the blade tip.

Unfortunately, for a moving turbine blade, it has been found in practice that the slot nearest to the blade base is not properly cooled. In addition, for a stator turbine blade, the slots nearest to the blade base and the blade tip are also not properly cooled. In fact, cracks tend to form in the trailing edge of the blade, in the vicinity of said slots. Such cracks jeopardize the lifetime of the blade, in particular, by decreasing its strength.

FIG. 7 shows where such cracks appear in a moving turbine blade. This figure is a fragmentary perspective view of a moving blade 100 of a high-pressure turbine. The blade 100 has an airfoil 102 that is connected at the blade base 104 to a platform 106 via a connection zone 108. The airfoil 102 of the blade extends axially between a leading edge (not shown in the figure) and a trailing edge 110. In order to cool the blade 100, air moves over said blade following a path formed by cavities (not shown) made inside the blade, before being expelled via evacuation slots 112 that open out in the airfoil 102 of the blade, at its trailing edge 110.

Each evacuation slot 112 is formed, in particular, by an end wall 114 provided with an opening (not shown) that opens into the cavities through which the cooling air flows. Each slot also has a setback wall 116 extending from the end wall 114 to the trailing edge 110 of the blade, and a top wall 118 and a bottom wall 120 that extend between the setback wall 116 and the airfoil 102 of the blade.

In practice, it has been found that one or more cracks 122 (a single crack is shown in the figure) form at the evacuation slot 112*a* that is nearest to the platform 106 (referred to below as the "bottom" slot). More precisely, cracks 122 form in the setback wall 116 of the bottom slot 112*a* and propagate axially from the trailing edge 110 of the blade towards the end wall 114 of the slot.

Such cracks arise mainly from a high concentration of stress in the bottom slot 112*a*, said stress being caused, in particular, by the bottom wall 120 of said bottom slot. There is the risk that such cracks may propagate over the entire airfoil 102 of the blade, thereby reducing its lifetime.

For a stator turbine blade, identical cracks appear both at the evacuation slot nearest to the platform disposed beside the blade base, and at the evacuation slot nearest to another platform connected to the blade at its tip (referred to below as the "top" slot).

In order to prevent cracks from appearing, U.S. Pat. No. 6,062,817 suggests, for a moving turbine blade, eliminating a portion of the bottom wall of the evacuation slot nearest to the platform, so that a portion of the setback wall of said slot extends radially between the top wall and the platform of the blade.

Nevertheless, that solution is insufficient. In fact, the bottom slot of the blade of that patent still has sharp edges on its bottom wall. The resulting sudden change in thickness prevents the cooling air evacuated via said slot from flowing properly. Thus, the evacuated air can no longer cool the connection zone between the platform and the blade base, so cracks that are particularly detrimental to the lifetime of the blade appear in that zone.

OBJECTS AND SUMMARY OF THE INVENTION

Therefore, the present invention aims at mitigating such drawbacks by proposing a turbine blade having the slot(s) nearest to the platform(s) that are of a shape serving both to avoid crack formation and to cool the connection zone between the platform(s) and the blade.

To this end, the invention provides a turbine blade of a turbomachine, having an airfoil extending radially from a blade base to a blade tip and axially from a leading edge to a trailing edge, at least a bottom platform connected to the base of the blade by a bottom connection zone, and a cooling circuit consisting of at least one cavity extending radially from the blade tip to the blade base, of at least one air inlet opening at a radial end of the cavity(ies), of a plurality of evacuation slots arranged along the trailing edge of the blade, said blade having a bottom evacuation slot that is disposed near the blade base, the bottom evacuation slot including an end wall provided with an opening that opens into the cavity(ies), a setback wall, a bottom wall disposed beside the blade base, a bottom edge formed between the setback wall and the bottom wall, and a bottom shoulder formed between the bottom wall and the bottom connection zone, wherein both the bottom edge of the bottom evacuation slot and the bottom shoulder of the bottom evacuation slot have respective right sections of substantially rounded shape, thereby avoiding any protruding angles between the opening of said slot and the bottom connection zone.

In this manner, the rounded shape of the right section of the bottom edge of the bottom evacuation slot and the bottom shoulder of the bottom evacuation slot prevent cracks from forming in the setback wall of said slot. Moreover, said rounded shape leads to an air cooling film being created in the bottom connection zone between the platform and the blade base in order to cool said zone. Hence, the temperature in the connection zone drops.

According to a particular provision of the invention, applicable to a stator nozzle blade, the blade further includes a top platform connected to the tip of the blade by a top connection zone, the cooling circuit further including a top evacuation slot disposed near the blade tip and having an end wall provided with an opening that opens into the cavity (ies), a setback wall, a top wall disposed beside the blade tip, a top edge formed by the setback wall and the top wall, and a top shoulder formed by the top wall and the top connection zone; wherein the top edge of the top evacuation slot and the top shoulder of the top evacuation slot have respective right sections of substantially rounded shape, thereby avoiding any protruding angles between the opening of said slot and the top connection zone.

Preferably, the rounded shapes of the right section of the edges and of the shoulders each extend axially from the opening of the evacuation slot to an outlet plane extending axially between said opening of the evacuation slot and the trailing edge of the blade.

Advantageously, the rounded shapes of the right section of the bottom edge and of the bottom shoulders each have a radius of curvature that increases from the opening of the evacuation slot to the outlet plane. In which case, said radii of curvature are preferably such that the setback wall of the evacuation slot coincides with the with the connection zone.

For a moving blade, the setback wall of the bottom evacuation slot may slope towards the blade tip and the opening in the end wall of the bottom evacuation slot may be formed essentially in the bottom connection zone.

The invention also provides a core for obtaining a blade such as described above, said core including a main portion designed for reserving space for the cooling cavity of the blade, the main portion being provided with a plurality of terminal flat tongues that are designed to reserve a corresponding number of spaces for the evacuation slots of the cooling circuit of the blade, wherein the main portion of the core further includes a bottom flat tongue at the location reserved for the bottom slot.

The invention further provides a high-pressure turbine of a turbomachine having a plurality of moving blades such as defined above, as well as a turbomachine nozzle having a plurality of stator blades such as defined above.

BRIEF DESCRIPTION OF THE DRAWINGS

Other characteristics and advantages of the present invention appear in the description below, with reference to the accompanying drawings, which show a non-limiting embodiment. In the figures.

DETAILED DESCRIPTION OF AN EMBODIMENT

Figure 1:
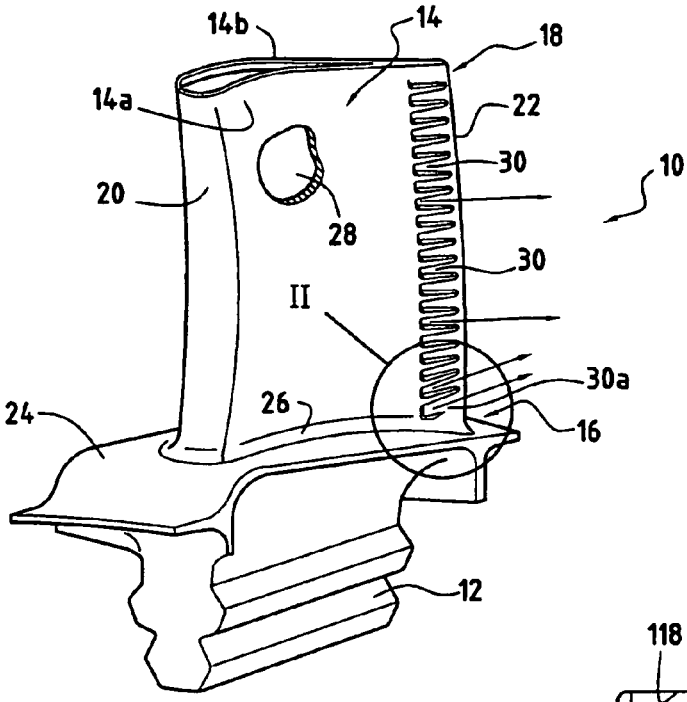
FIG. 1 is a perspective view of a moving turbine blade of the invention.
Figure 7:
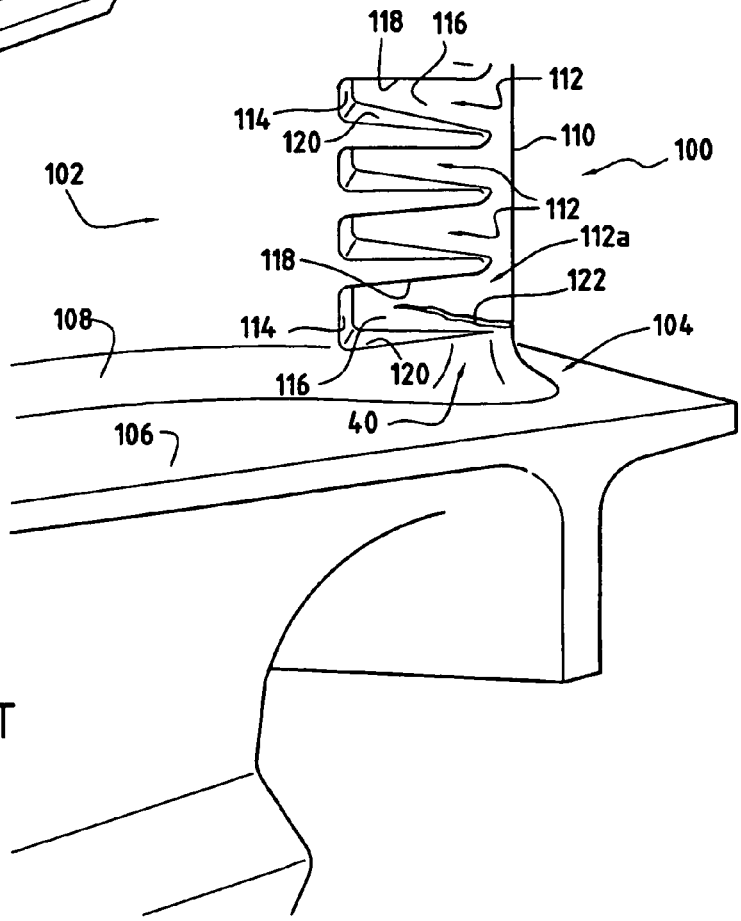
FIG.7 PRIOR ART
FIG. 7, described above, is a fragmentary perspective view of a moving turbine blade of the prior art.

FIG. 1 shows in perspective a moving blade 10 of a high pressure turbine of a turbomachine. The blade 10 is secured to a moving turbine wheel (not shown) via a fir tree root 12.

The blade 10 comes in the form of an airfoil 14 that extends radially between a blade base 16 and a blade tip 18 and axially between a leading edge 20 and a trailing edge 22. Hence, the airfoil 14 of the blade defines the concave surface 14*a* and the convex surface 14*b* of the blade.

The root 12 of the blade 10 connects to the blade base 16 at a bottom platform 24 that defines a wall along which the stream of combustion gases flows through the turbine. The platform 24 is connected to the blade base 16 by a bottom connection zone 26.

The blade, which is subjected to the very high temperatures of combustion gases passing through the turbine, needs to be cooled down. To this end, and in a known manner, the blade 10 has one or more internal cooling circuits.

Each cooling circuit consists of at least one cavity 28 extending radially between the blade base 16 and the blade tip 18. The cavity is supplied with cooling air at a radial end by an air inlet opening (not shown). Generally, said air inlet opening is provided in the root 12 of the blade 10.

In order to evacuate the cooling air that flows in the cavity 28 of the cooling circuits, a plurality of slots are distributed along the length of the trailing edge 22, between the blade base 16 and the blade tip 18. Said evacuation slots 30 open into the cavity 28 and open out in the concave surface 14*a* of the blade, at its trailing edge 22.

Figure 2:
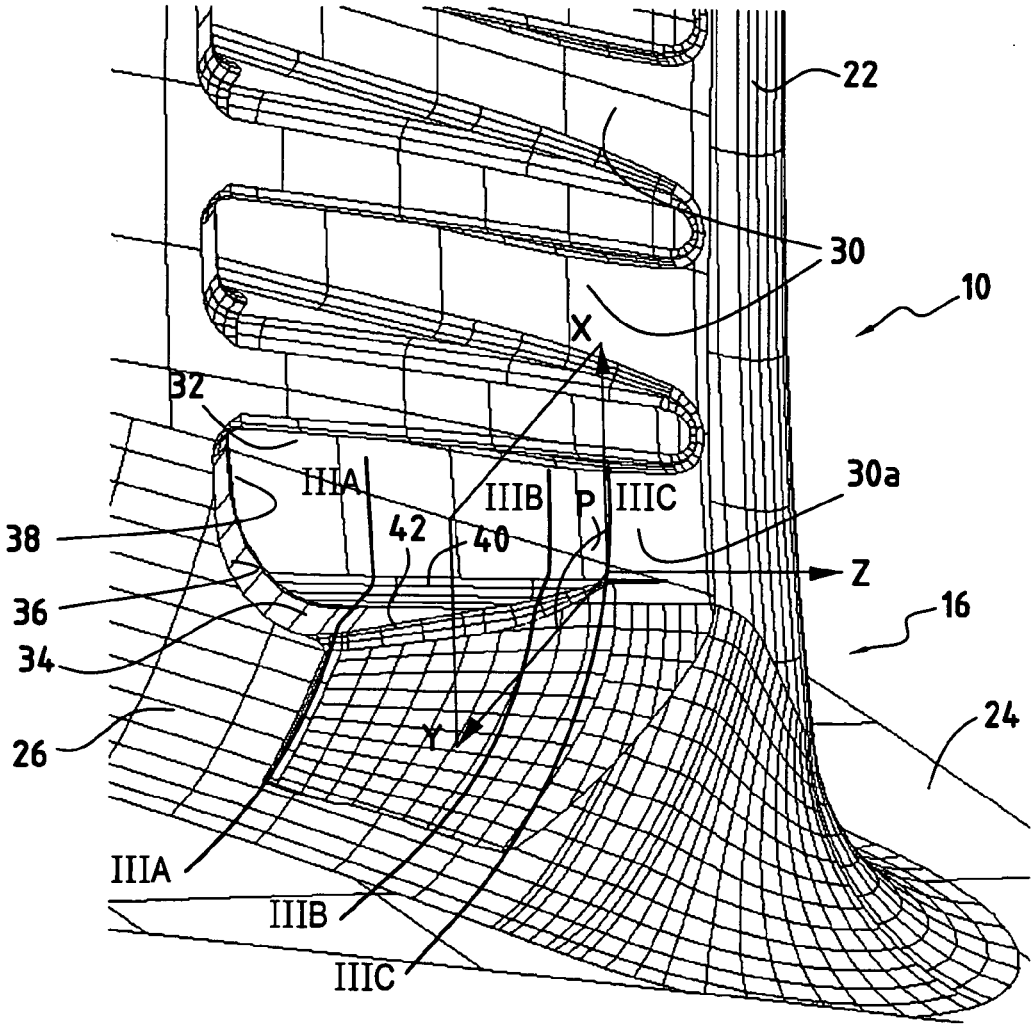
FIG. 2 is a fragmentary perspective view of the bottom air evacuation slot of the blade in FIG. 1.
Figure 3A:
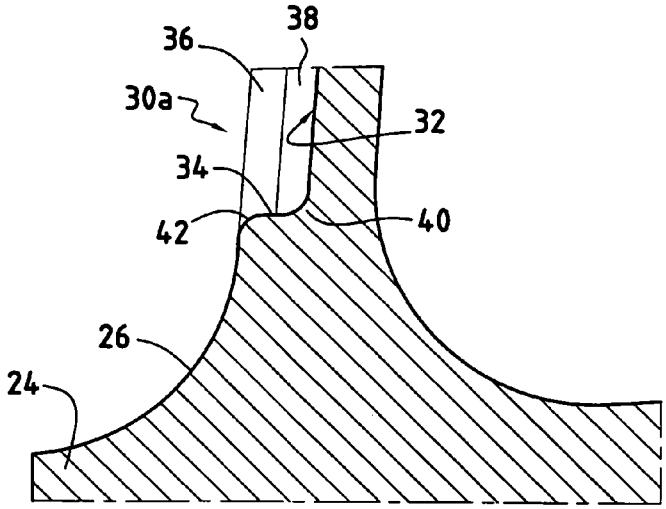
FIGS. 3A, 3B and 3C are cross-sections on the lines IIIA, IIIB and IIIC, respectively, of FIG. 2.
Figure 3B:
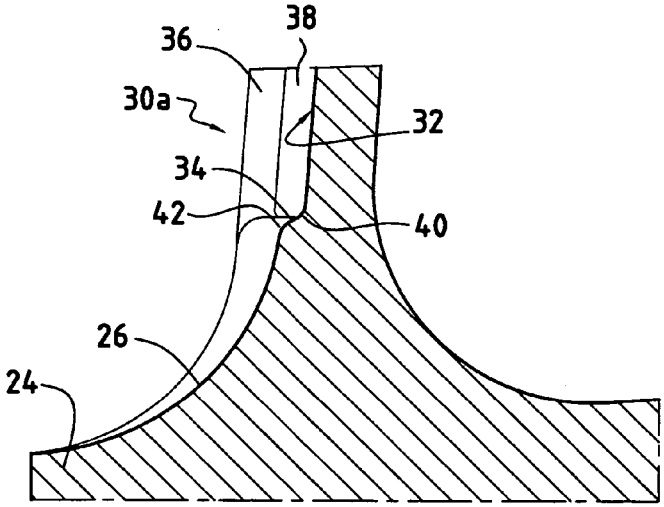
Figure 3C:
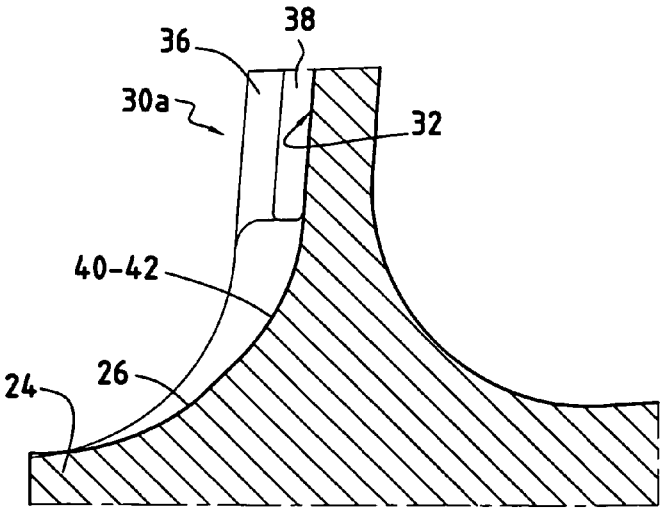

More particularly, as shown in FIG. 2 and in FIGS. 3A, 3B and 3C, the blade 10 has a bottom evacuation slot that is disposed near the blade base 16. Of all the evacuation slots 30, this bottom slot 30*a* is the slot nearest to the bottom platform 24.

The bottom evacuation slot 30*a* consists of a setback wall (or, setback) 32, of a bottom wall (or step) 34, and of an end wall 36, said end wall being provided with an opening 38 that opens into the cooling circuit cavity 28.

The term "bottom" wall is used to describe the wall that is disposed beside the blade base 16. The setback wall 32 extends radially from the bottom wall 34 towards the blade tip 18, and axially from the end wall 36 to the trailing edge 22 of the blade. Moreover, the bottom wall 34 extends from the setback wall 32 to the bottom connection zone 26.

The particular shape of the bottom evacuation slot 30*a* directs the air coming from the cooling circuit cavity through the opening 38, thereby cooling the trailing edge 22 of the blade, which edge is the thinnest portion of the blade, and therefore the most exposed to the high combustion gas temperatures.

According to the invention, the bottom edge 40 of the evacuation slot 30*a* and the bottom shoulder 42 of the bottom evacuation slot 30*a* both have right sections of substantially rounded shape, thereby avoiding any protruding angles between the opening 38 of the slot 30*a* and the bottom connection zone 26. This prevents cracks from forming in the setback wall 32 of the bottom evacuation slot 30*a*.

According to a particular characteristic of the invention, the rounded shapes of the right section of the bottom edge 40 and of the bottom shoulder 42 each extend axially from the opening 38 of the bottom evacuation slot 30*a* to an outlet plane P extending axially between the opening of the evacuation slot and the trailing edge 22 of the blade.

The outlet plane P may be defined relative to a system of coordinates formed by axes X, Y and Z, shown in FIG. 2. Relative to said system of coordinates, the outlet plane P is parallel to the plane XY.

According to another particular characteristic of the invention, the rounded shapes of the right section of the bottom edge 40 and of the bottom shoulder 42 have respective radii of curvature that increase going from the opening 38 of the bottom evacuation slot 30*a* towards the outlet plane P.

This characteristic is shown, in particular, in FIGS. 3A, 3B, and 3C, which figures clearly show that the radii of curvature of the bottom edge 40 and of the bottom shoulder 42 gradually increase on going away from the opening 38. Thus, in FIG. 3A, which is the cross-section nearest to the opening 38 of the bottom slot 30*a*, said radii of curvature are smaller than the radii of curvature in FIG. 3C, which shows a cross-section in the outlet plane P.

The radii of curvature of the bottom edge 40 and the bottom shoulder 42 may vary in different ways. Indeed, said radii of curvature may remain constant or decrease, on going away from the opening 38.

Moreover, on going away from the opening 38 of the bottom slot 30*a*, the width (across the airfoil) of the bottom wall 34 decreases so that it disappears completely in the cross-section shown in FIG. 3C (i.e. at the outlet plane P).

According to yet another particular characteristic of the invention, also shown in FIG. 3C, at the outlet plane P, the radii of curvature of the rounded shapes of the bottom edge 40 and of the bottom shoulder 42 are such that the setback wall 32 of the bottom slot 30*a* coincides with the bottom connection zone 26.

In addition, the radii of curvature of the rounded shapes of the bottom edge 40 and of the bottom shoulder 42 also coincide with each other at the outlet plane P. This arises from the fact that the width (across the airfoil) of the bottom wall 34 of the bottom slot disappears at the outlet plane P.

Therefore, it is possible to retain a part of the air-guiding function for guiding the air that comes out from the cavity 28 of the cooling circuit, and that is evacuated through said cavity.

Thus, all sharp discontinuities in the thickness of the bottom slot 30*a* and in the thickness of the connection zone 26 are eliminated, so that a cooling film is created on the concave surface 14*a* of the connection zone 26. Therefore, the cooling air coming from the opening 38 of the bottom slot 30*a* "sweeps over" the connection zone 26, thereby reducing the temperature thereon.

Figure 4:
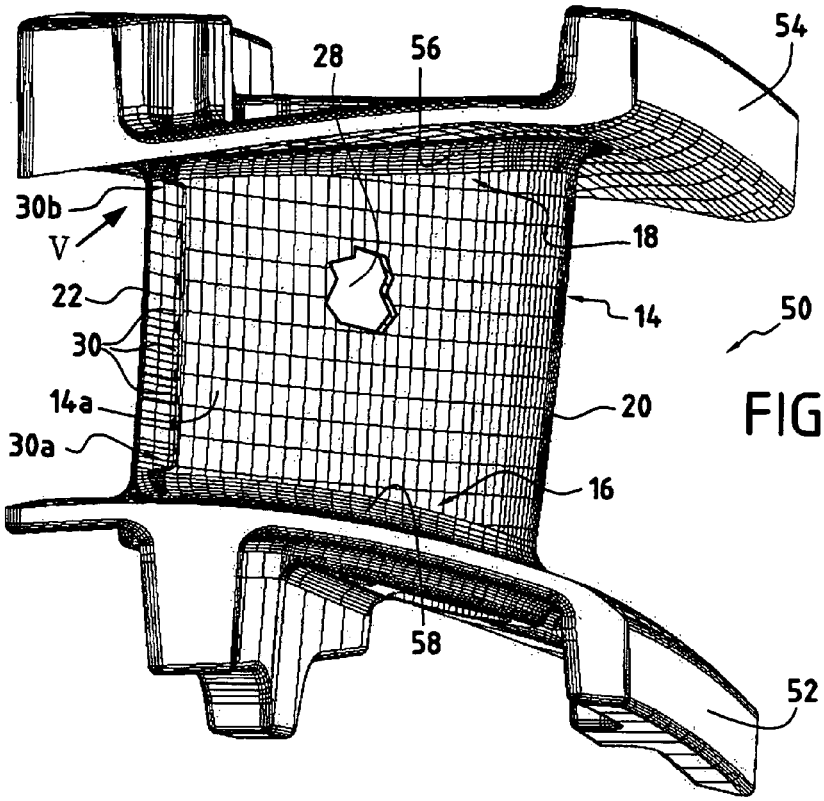
FIG. 4 is a perspective view of a stator turbine blade of the invention.

The particular shape of the bottom evacuation slot can be applied both to a moving turbine blade, such as the blade shown in FIG. 1, and to a stator nozzle blade, such as the blade shown in FIG. 4.

Hence, FIG. 4 shows a stator nozzle blade 50 of a high pressure turbine of a turbomachine. References in FIG. 4 that are identical to references in FIG. 1, designate the same elements as those described in FIG. 1.

Compared with the rotor blade described with reference to FIG. 1, said stator blade 50 is mounted between two platforms, i.e. between a bottom platform 52 and a top platform 54. The top platform 54 is connected to the tip 18 of the blade by a top connection zone 56, whereas the bottom platform 52 is connected to the blade base 16 by a bottom connection zone 58.

As for the stator blade in FIG. 1, the cooling circuit for the stator blade 50 has a plurality of evacuation slots 30, one of which is a bottom slot 30*a* that opens into the cooling cavity 28, that is disposed near the blade base 16 and that opens out in the concave surface 14*a* of the blade. The features of said bottom evacuation slot 30*a* are the same as the features of the moving blade in FIG. 1.

Moreover, the cooling circuit of the stator blade 50 also has a top evacuation slot 30*b* that also opens into the cooling cavity 28 and that is disposed near the blade tip 18. Said top slot 30*b* opens out in the concave surface 14*a* of the blade 50.

Figure 5:
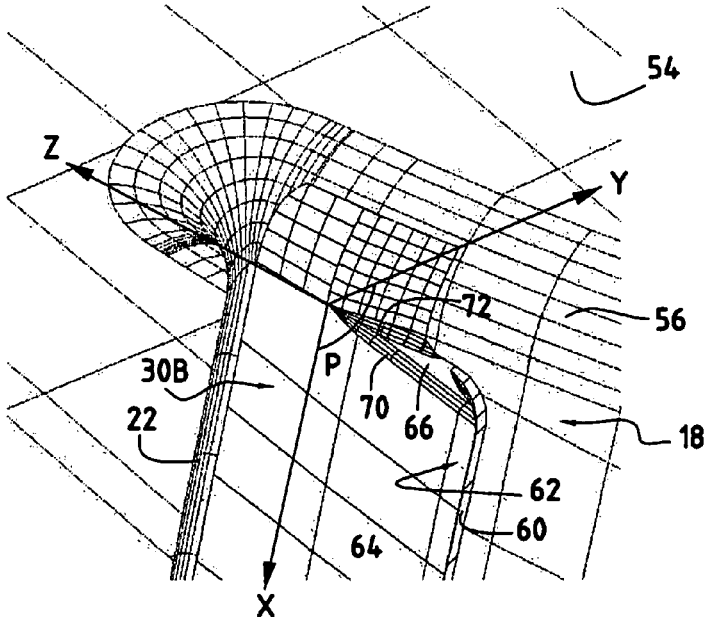
FIG. 5 is a fragmentary perspective view of the top air evacuation slot of the blade in FIG. 4.

As shown in FIG. 5, said top slot 30*b* consists of an end wall 60 provided with an opening 62 opening into the cooling cavity 28, of a setback wall 64, and of a top wall 66 disposed beside the blade tip 18. The term "top" wall 66 is used to designate the wall that is situated beside the blade tip 18.

A top edge 70, as formed by the setback wall 64 and the top wall 66, and a top shoulder 72, as formed by the top wall 66 and the top connection zone 56, can thus be defined for said slot 30*b*.

In accordance with the invention, both the top edge 70 of the top evacuation slot 30*b* and the top shoulder 72 of the top evacuation slot 30*b* have respective right sections of substantially rounded shape, thereby avoiding any protruding angles between the opening 62 of the slot 30*b* and the top connection zone 56.

By symmetry, the particular features of the bottom slot of the blade as described above with reference to FIGS. 1, 2, 3A, 3B and 3C, also apply to the top slot 30*b* of said stator blade 50.

Generally, the rotor blade 10 and the stator blade 50 of the invention are obtained directly by casting.

To this end, the blade is made by casting a metal into a mold containing a ceramic core, said core serving, in particular, to reserve space for the cooling circuit of the blade (i.e. for the cavity 28 and each evacuation slot 30, 30*a* and 30*b*). Once the metal has been cast into the mold, the blade is cooled, and the ceramic core is withdrawn.

Figure 6:
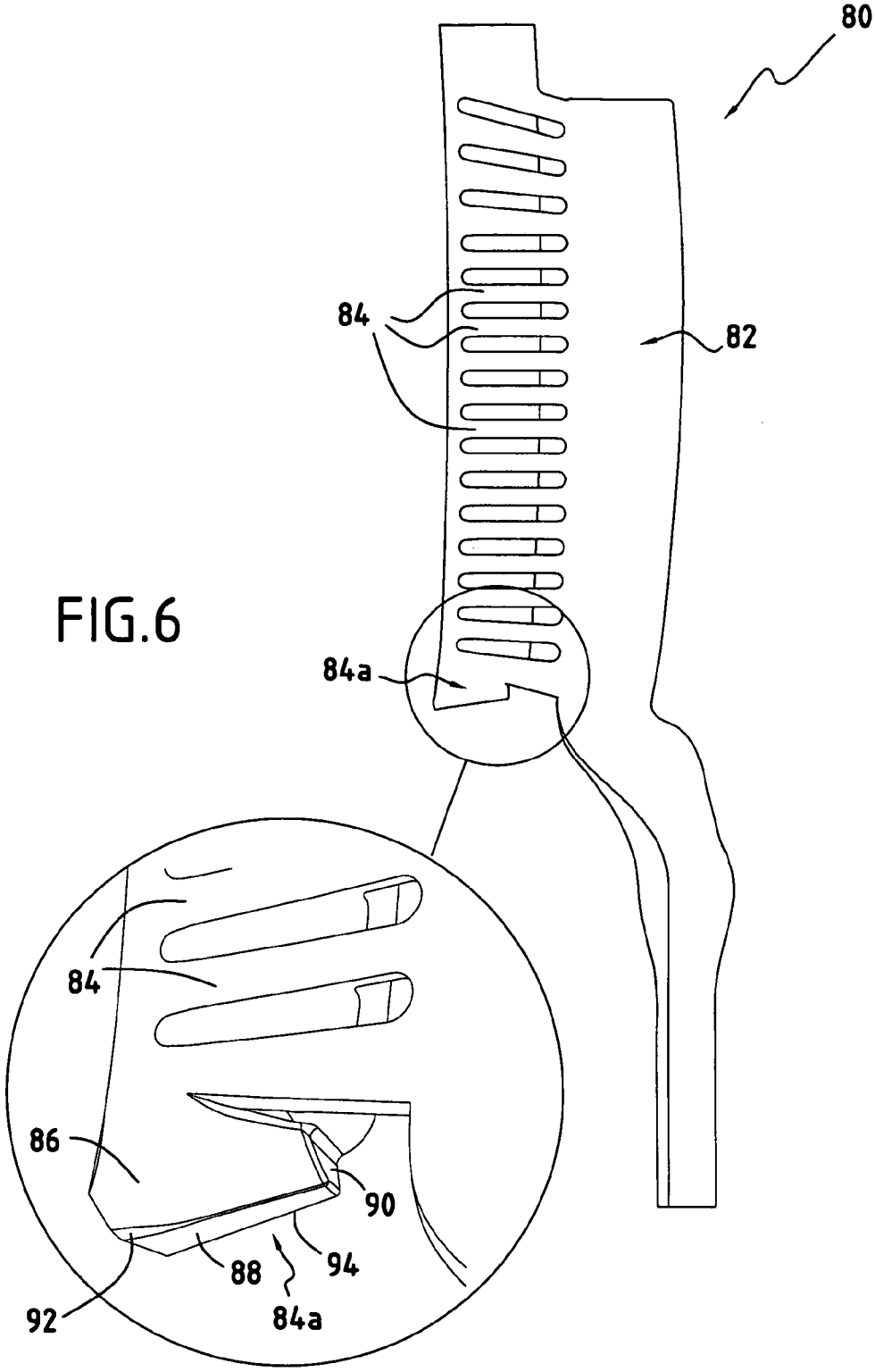
FIG. 6 is a fragmentary perspective view of a core for obtaining the blade in FIG. 1.

FIG. 6 shows a ceramic core 80 for reserving space for the cooling circuit of the moving blade 10 in FIG. 1. FIG. 6 shows said core as seen from the convex side of the blade.

The core 80 has a main portion 82 designed for reserving space for the cooling cavity(ies) of the blade. Said main portion 82 is provided with a plurality of terminal flat tongues (or fingers) 84 that are designed to reserve a corresponding number of spaces for the evacuation slots of the cooling circuit of the blade.

In order to obtain the rounded shapes of the right section of the bottom edge and of the bottom shoulder of the bottom evacuation slot of the blade in the casting as cast, the ceramic core 80 has a bottom flat tongue 84*a* in the space reserved for the bottom slot, said flat tongue of shape complementary to said rounded shapes.

More precisely, the bottom flat tongue 84*a* has a first face 86 of shape complementary to the setback wall of the bottom slot, a second face 88 of shape complementary to the bottom wall of said slot, and a third face 90 of shape complementary to the end wall.

Thus, the bottom face 92 formed between the first face 86 and the second face 88 has a right section that is substantially rounded. Moreover, the bottom shoulder 94, formed between the second face 88 and a face (not shown) of shape complementary to the bottom connection zone of the blade at the bottom platform, also has a right section that is substantially rounded.

In this manner, it is possible to reproduce the same rounded shapes for the right sections of the bottom edges and the bottom shoulders of the bottom evacuation slots of a series of blades.

Of course, with a stator blade such as the blade described with reference to FIGS. 4 and 5, the ceramic core for such a blade also has a top flat tongue in the space reserved for the top evacuation slot, which makes it possible to reproduce the rounded shapes of the right section of the top edge and of the top shoulder.

According to another particular characteristic of the invention applied to a moving blade, the setback wall 32 of the bottom evacuation slot 30*a* slopes towards the blade tip. Said slope (e.g. in the order of 10° to 30°), which is shown, in particular, in FIG. 1, also makes it possible to increase cooling in the connection zone 26 between the platform 24 and the blade base 16.

Moreover, still in order to improve cooling in the connection zone 26, the opening 38 in the bottom evacuation slot 30*a* of such a moving blade 10 is preferably formed essentially in the connection zone 26, between the platform 24 and the blade base 16.

What is claimed is:

1. A turbine blade of a turbomachine, comprising:

an airfoil extending radially from a blade base to a blade tip and axially from a leading edge to a trailing edge;

at least a bottom platform connected to the base of the blade by a bottom connection zone; and a cooling circuit consisting of at least one cavity extending radially from the blade tip to the blade base, of at least one air inlet opening at a radial end of the cavity(ies), of a plurality of evacuation slots arranged along the trailing edge of the blade, said blade having a bottom evacuation slot that is disposed near the blade base, said bottom evacuation slot including:

an end wall provided with an opening that opens into the cavity(ies);

a setback wall;

a bottom wall disposed beside the blade base;

a bottom edge formed between the setback wall and the bottom wall; and a bottom shoulder formed between the bottom wall and the bottom connection zone;

wherein both the bottom edge of the bottom evacuation slot and the bottom shoulder of the bottom evacuation slot have respective right sections of substantially rounded shape, thereby avoiding any protruding angles between the opening of said slot and the bottom connection zone.

2. A blade according to claim 1, further including a top platform connected to the tip of the blade by a top connection zone, the cooling circuit further including a top evacuation slot disposed near the blade tip, comprising:

an end wall provided with an opening that opens into the cavity(ies);

a setback wall;

a top wall disposed beside the blade tip;

a top edge formed by the setback wall and the top wall; and a top shoulder formed by the top wall and the top connection zone;

wherein the top edge of the top evacuation slot and the top shoulder of the top evacuation slot have respective right sections of substantially rounded shape, thereby avoiding any protruding angles between the opening of said slot and the top connection zone.

3. A blade according to claim 2, wherein the respective right sections of the top edge of the evacuation slot and of the top shoulder of the top evacuation slot respectively transition from the setback wall of the top evacuation slot to the top wall and from the top wall to the top connection zone without any protruding edges.

4. A blade according to claim 2, wherein the top evacuation slot is nearest the blade tip.

5. A blade according to claim 2, wherein the right sections of the top edge of the evacuation slot and of the top shoulder of the top evacuation slot eliminate all sharp discontinuities between a first thickness of the top evacuation slot and a second thickness of the top connection zone.

6. A blade according to claim 2, consisting of a stator nozzle blade of a high pressure turbine of a turbomachine.

7. A turbomachine nozzle, having a plurality of stator blades, according to claim 6.

8. A blade according to claim 1, wherein the rounded shapes of the right section of the edges and of the shoulders each extend axially from the opening of the evacuation slot to an outlet plane extending axially between said opening of the evacuation slot and the trailing edge of the blade.

9. A blade according to claim 8, wherein the rounded shapes of the right section of the bottom edge and of the bottom shoulders each have a radius of curvature which increases from the opening of the evacuation slot to the outlet plane.

10. A blade according to claim 9, wherein, at the outlet plane, the radii of curvature of the rounded shapes of the right section of the bottom edges and of the shoulders are such that the setback wall of the evacuation slot coincides with the connection zone.

11. A blade according to claim 1, consisting of a moving blade in a high-pressure turbine of a turbomachine.

12. A blade according to claim 11, wherein the setback wall of the bottom evacuation slot slopes towards the blade tip.

13. A blade according to claim 11, wherein the opening in the end wall of the bottom evacuation slot is formed essentially in the bottom connection zone.

14. A high-pressure turbine of a turbomachine, having a plurality of moving blades, according to claim 11.

15. A core for obtaining a blade according to claim 1, including a main portion designed for reserving space for the cooling cavity of the blade, said main portion being provided with a plurality of terminal flat tongues that are designed to reserve a corresponding number of spaces for the evacuation slots of the cooling circuit of the blade, wherein the main portion of the core further includes a bottom flat tongue in the space reserved for the bottom slot, said flat tongue of shape complementary to said bottom slot.

16. A blade according to claim 1, wherein the respective right sections of the bottom edge of the bottom evacuation slot and the bottom shoulder of the bottom evacuation slot respectively transition from the setback wall of the bottom evacuation slot to the bottom wall and from the bottom wall to the bottom connection zone without any protruding edges.

17. A blade according to claim 1, wherein the bottom evacuation slot is nearest the blade base.

18. A blade according to claim 1, wherein the right sections of the bottom edge of the bottom evacuation slot and the bottom shoulder of the bottom evacuation slot eliminate all sharp discontinuities between a first thickness of the bottom evacuation slot and a second thickness of the bottom connection zone.

19. A turbine blade of a turbomachine, comprising:

an airfoil extending radially from a blade base to a blade tip and axially from a leading edge to a trailing edge;

at least a bottom platform connected to the base of the blade by a bottom connection zone; and a cooling circuit consisting of at least one cavity extending radially from the blade tip to the blade base, of at least one air inlet opening at a radial end of the cavity(ies), of a plurality of evacuation slots arranged along the trailing edge of the blade, said blade having a bottom evacuation slot that is disposed near the blade base, said bottom evacuation slot including:

an end wall provided with an opening that opens into the cavity(ies);

a setback wall;

a bottom wall disposed beside the blade base;

a bottom edge formed between the setback wall and the bottom wall; and a bottom shoulder formed between the bottom wall and the bottom connection zone;

wherein both the bottom edge of the bottom evacuation slot and the bottom shoulder of the bottom evacuation slot have respective right sections of substantially rounded shape, thereby avoiding any protruding angles between the opening of said slot and the bottom connection zone, and wherein the setback wall of the bottom evacuation slot slopes towards the blade tip.

* * * * *